US005484676A

United States Patent [19]

Takasu

[11] Patent Number: 5,484,676

[45] Date of Patent: Jan. 16, 1996

[54] DEVELOPER FOR ELECTROPHOTOGRAPHY AND METHOD FOR ELECTROPHOTOGRAPHIC DEVELOPMENT USING THE SAME

[75] Inventor: Yoshiaki Takasu, Shizuoka, Japan

[73] Assignee: Tomoegawa Paper Co., Ltd., Tokyo, Japan

[21] Appl. No.: 347,248

[22] Filed: Nov. 10, 1994

Related U.S. Application Data

[63] Continuation of Ser. No. 977,844, Nov. 17, 1992, abandoned.

[30] Foreign Application Priority Data

Nov. 27, 1991 [JP] Japan ..... 3-335931

[51] Int. Cl.[6] ..... G03G 9/083

[52] U.S. Cl. ..... 430/106.6; 430/109; 430/120

[58] Field of Search ..... 430/106.6, 109, 430/120

[56] References Cited

U.S. PATENT DOCUMENTS

| | | | |
|---|---|---|---|
| 4,334,497 | 6/1982 | Oka et al. . | |
| 4,414,322 | 11/1983 | Miyakawa et al. | 430/109 |
| 4,640,880 | 2/1987 | Kawanishi et al. . | |
| 4,935,325 | 6/1990 | Kuribayashi et al. | 430/106.6 |
| 4,957,840 | 9/1990 | Sakashita et al. | 430/109 |
| 5,064,739 | 11/1991 | Asanae et al. | 430/106.6 |
| 5,137,796 | 8/1992 | Takiguchi et al. | 430/106.6 |

FOREIGN PATENT DOCUMENTS

| | | |
|---|---|---|
| 0058013A2 | 8/1982 | European Pat. Off. . |
| 0139020A1 | 5/1985 | European Pat. Off. . |
| 0395026A2 | 10/1990 | European Pat. Off. . |
| 2620539 | 3/1989 | France . |

OTHER PUBLICATIONS

Patent Abstract of Japan Application No. 60–26953, vol. 9, No. 148.

Weast, et al., "CRC Handbook of Chemistry and Physics" CRC Press, Inc., Boca Raton, Fla., p. F–115, col. 2, para. 14–p. F–116, col. 1 European Search Report dated Jan. 26, 1993.

*Primary Examiner*—Christopher D. Rodee

*Attorney, Agent, or Firm*—Finnegan, Henderson, Farabow, Garrett & Dunner

[57] ABSTRACT

A developer for electrophotography and a method for electrophotographic developing using the same are disclosed. The developer for electrophotography comprises a magnetic carrier, and a magnetic toner which includes a magnetic powder having at most 100 oersted of a coercive force and satisfying the following formula:

$$Ms/Mr \geqq 20$$

wherein Ms represents a saturation magnetization and Mr represents a residual magnetization. The developer for electrophotography can be used in a developing device wherein a magnetic roll rotates at a peripheral speed of 300 mm/sec or faster and a sleeve encompassing the magnetic roll rotates at a peripheral speed of 50 mm/sec or faster in opposite directions.

7 Claims, No Drawings

DEVELOPER FOR ELECTROPHOTOGRAPHY AND METHOD FOR ELECTROPHOTOGRAPHIC DEVELOPMENT USING THE SAME

This application is a continuation, of application Ser. No. 07/977,844, filed Nov. 17, 1992, now abandoned.

BACKGROUND OF THE INVENT ION

1. Field of the Invention

The present invention relates to a developer for electrophotography and a method for electrophotographic developing using the same, which is useful for developing an electrostatic latent image formed by an electrophotographic method, an electrostatic recording method or an electrostatic printing method.

2. Prior Art

In general, according to an electrophotographic method, a copy image is prepared by developing an electrostatic latent image formed on a photo-conductor using a developer to form a toner image, and optionally transferring the toner image on a transfer member, followed by fixing the toner image to the transfer member. In the electrophotographic method described above, heretofore, a two-component developer has been known which consists essentially of a non-magnetic toner and a magnetic carrier.

A method for electrophotographic developing using the two-component developer (hereafter referred to as a "two-component method for developing") comprises the steps of: (1) mixing a non-magnetic toner and a magnetic carrier in a predetermined ratio; (2) subjecting the mixture to a triboelectric charging treatment until the non-magnetic toner is charged with a desired polarity; and (3) fixing only the non-magnetic toner (and not the magnetic carrier) on a photo-conductor. Although the two component method for developing has an advantage in that the image transfer to a paper sheet is facile due to a high electric resistance of the non-magnetic toner, the method has the following drawbacks:

(1) A mixer for mixing the non-magnetic toner and the magnetic carrier must be handled with care in order to afford an adequate triboelectric charging to the two components;

(2) Since only the non-magnetic toner is consumed (i.e. fixed) during the developing step, there is a need for a toner density sensor to control the toner-to-carrier ratio, resulting in a large and complex developing device; and (3) During the use of the two-component developer, the magnetic carrier is exhausted so that the life of the two-component developer is terminated within a relatively short period of time.

In contrast to the two-component developer, a single-component developer which includes a magnetic powder and a binder resin as the main ingredients and which is freed from a carrier, has been proposed. Due to the absence of a carrier in a single-component method for developing, it is not necessary to control the toner density. Therefore, the toner density sensor, described above, is not necessary. However, in order to secure excellent accuracy of the space between a blade and a sleeve surface of a developing device and the space between the sleeve surface and a photo-conductor, it is necessary to have a method for development that forms a uniform magnetic brush of toner on the surface of the sleeve.

In order to overcome the disadvantages described above in the two-component developer and the single-component developer, various developers which include magnetic toners and magnetic carriers have been proposed.

For example in U.S. Pat. No. 4,640,880, the developer includes both a magnetic toner and a magnetic carrier. In comparison with the conventional two-component developer, this developer is distinguished by the usage of a larger (20% or more) amount of magnetic toner. In other words, the ratio of the magnetic carrier to the magnetic toner in the developer is small, making it difficult for the relatively small amount of magnetic carrier to contact with the magnetic toner. For this reason, the desired triboelectric charging of the magnetic toner cannot be obtained. In order to avoid this problem, the developing device must have a high-speed rotating sleeve and a high-speed rotating magnetic roll so that a sufficient triboelectric charging to the magnetic tone can be attained. Therefore, the capacity of the main motor must be expanded, or an additional high-speed motor for driving the sleeve and the magnetic roll is needed, resulting in a a large-sized and/or costly developing device.

SUMMARY OF THE INVENTION

It is therefore an objective of the present invention to provide a developer for electrophotography and a method for electrophotographic developing using the same, in which a triboelectric charging between a magnetic toner and a magnetic carrier is excellent in the absence of a high-speed rotating sleeve or magnetic roll in a developing device, and in which a high-quality image exhibiting an adequate image density without defective images such as blotted or blurred images in thin lines, characters and the like, can be obtained.

An aspect of the present invention is directed to providing a developer for electrophotography comprising a magnetic carrier, and a magnetic toner which includes a magnetic powder having at most 100 oersted of a coercive force (Hc) and satisfying the following formula:

$$Ms/Mr \geqq 20$$

wherein Ms represents a saturation magnetization and Mr represents a residual magnetization.

Another aspect of the present invention is directed to providing a method for electrophotographic developing comprising the steps of:

(1) preparing a developer for electrophotography comprising a magnetic carrier, and a magnetic toner which includes a magnetic powder having at most 100 oersted of a coercive force (Hc) and satisfying the following formula:

$$Ms/Mr \geqq 20$$

wherein Ms represents a saturation magnetization and Mr represents a residual magnetization;

(2) preparing a developing device equipped with a magnetic roll, and a sleeve encompassing the magnetic roll;

(3) preparing a photo-conductor on which an electrostatic latent image is formed;

(4) subjecting a surface of the sleeve to a magnetic attraction using the developer for electrophotography;

(5) subsequently rotating the magnetic roll at a peripheral speed of 300 mm/sec or faster and the sleeve at a peripheral speed of 50 mm/sec or faster in opposite directions, to carry the developer for electrophotography; and (6) subsequently contacting the developer with the photoconductor on which the electrostatic latent image is formed to develop the electrostatic latent image.

The above objectives and effects, features, and advantages of the present invention will become more apparent from the following description of specific examples thereof.

DETAILED DESCRIPTION OF THE INVENTION

In the present invention, a magnetic powder included in a magnetic toner needs to be employed which has at most 100 oersted of a coercive force (Hc) and satisfies the following formula:

$$Ms/Mr \geqq 20$$

wherein Ms represents a saturation magnetization and Mr represents a residual magnetization.

A class of the magnetic powder included in the magnetic toner may contain: (1) a metal such as cobalt, copper, iron, nickel or the like; (2) an alloy composed of a metal such as aluminum, cobalt, copper, iron, nickel, magnesium, tin, zinc, gold, silver, selenium, titanium, tungsten, zirconium or the like; (3) a metal oxide such as aluminum oxide, iron oxide, nickel oxide or the like; (4) a ferrite; a magnetite; or (5) a mixture thereof. In these examples of the magnetic powder, a ferrite powder is the most preferable material since the magnetic properties of the ferrite powder can be easily adjusted. The ferrite has a composition of $Fe_2O_3$ and MO; wherein M represents at least one element selected from the group consisting of manganese (Mn), nickel (Ni), cobalt (Co), magnesium (Mg), copper (Cu), zinc (Zn), and cadmium (Cd). The ferrite powder may be prepared, for example, by the following steps: (1) wet-mixing the raw materials described above; (2) drying the mixture; (3) preliminary sintering the dried mixture for several hours at a temperature in a range of from 800° C. to 1000° C. (4) pulverizing the sintered mixture to form an intermediate product for granulation; (5) mixing the intermediate product with a dispersing agent, a binder, water, and the like to form a Slurry product; (6) granulating the slurry product by means of a spray dryer; (7) sintering the the granulated product at a temperature in a range of from 1100° C. to 1300° C.; and (8) classifying the sintered product to obtain a ferrite powder.

The magnetic properties (Ms, Mr, and Hc) of the ferrite powder described above can be adjusted, for example, by changing the composition, the particle size or the particle shape of the powder. In other words, a saturation magnetization (Ms) can be adjusted according to the composition of the ferrite powder, and more precisely according to the amount of the metal oxide (MO).

A residual magnetization (Mr) depends on the particle size and the particle shape of the ferrite powder. As the particle shape approaches a perfect sphere, the residual magnetization (Mr) will become smaller. In addition, the residual magnetization (Mr) is inversely affected by the particle size of the ferrite powder (i.e. the smaller the size, the larger the Mr).

A coercive force (Hc) also depends on the particle size and the particle shape of the ferrite powder. The closer the particle shape is to a perfect sphere, the smaller the coercive force (Hc) will become. In addition, the smaller the particle size is, the larger the coercive force (Hc) will become.

In the present invention, the values of the magnetic properties such as the saturation magnetization (Ms), the residual magnetization (Mr), and the coercive force (Hc) of the ferrite powder are the data obtained in the case where an outer magnetic field of 5,000 oersted is exerted on the magnetic powder at a temperature of 18° C. and a humidity of 50% RH using a vibration sample type magnetometer ("VSM-P7", produced by Toei Industry Co., Ltd.).

The magnetic powder employed in the present invention must have at most 100 oersted of a coercive force (Hc) and a relation between saturation magnetization (Ms) and residual magnetization (Mr) where "Ms/Mr≧20", as described above. If the ratio of Ms/Mr is smaller than 20, the rolling of the magnetic toner on the sleeve of the developing device becomes worse. For this reason, an adequate triboelectric charging cannot be attained, resulting in poor image density. In the case where the coercive force (Hc) is greater than 100 oersted, the toner developed on the photoconductor is adversely affected by the magnetic field of the magnetic roll located inside of the sleeve of the developing device, resulting in a defective image such as a so-called tailing image which is formed at the end of a black solid image and is due to toner scattering.

The magnetic toner employed in the present invention is prepared by the following steps: (1) dry-blending the magnetic powder described above and a binder resin, optionally an electric charge control agent, a coloring agent, and additives in a predetermined ratio; (2) heat-melting and kneading the blended mixture using an extruder, a roll mill or the like to form a block; (3) pulverizing the block by means of a mechanical crusher such as a jet mill or the like; and (4) classifying the pulverized mixture into a predetermined particle size to obtain the desired magnetic toner. If necessary, a fluidity modifier or the like can be adhered to the surface of the magnetic toner by means of a high-speed mixer ("Henschel Mixer", produced by Mitsui Miike Engineering Co., Ltd.) or the like.

In the magnetic toner employed in the present invention, it is preferable that the magnetic powder be included in the amount of 20 parts by weight to 70 parts by weight based on 100 parts by weight of the binder resin. With less than 20 parts by weight of the magnetic powder included in the magnetic toner, it is difficult for the magnetic toner to have a magnetic attraction on the sleeve surface. For this reason, the magnetic toner will separate from the sleeve surface, causing contamination of the developing device. However, when the magnetic powder is included in the amount of more than 70 parts by weight in the magnetic toner, the toner is liable to have a magnetic attraction that will result in a decreased carrying property of the developer. For this reason, the magnetic toner does not have adequate triboelectric charging and therefore the image density is lowered.

A class of binder resin useful in the present invention may include a styrene resin, a polyacrylate resin, a styrene-acrylate copolymer resin, a polychlorovinyl resin, a polyvinyl acetate resin, a polychlorovinylidene resin, a phenol resin, an epoxy resin, a polyester resin, or the like. These resins may be employed alone or as a mixture thereof.

A suitable electric-charge control agent in the magnetic toner preferably includes a nigrosine dye compound, a quaternary ammonium salt, a metal complex dye, a titanate or carbonate composed of calcium, barium or the like, an alkoxylated amine, a polyamide resin such as nylon or the like, or a polyamine resin such as a condensation polymer including an amino group. The appropriate charge control agent is selected from the group described above in accordance with the triboelectric polarity of the magnetic toner.

As a coloring agent included in the magnetic toner, a conventional dye or pigment may be used. For example, suitable coloring agent includes carbon black, aniline blue, alkoyl blue, chrome yellow, ultramarine blue, DuPont oil red (trademark), quinoline yellow, methylene blue chloride, copper phthalocyanine blue, malachite blue, or a dye including a transition metal such as copper, chromium or the like.

Various additives may be included in the magnetic toner employed in the present invention, as necessary. Classes of the additives include a lubricant, an abrasive material, a fixing agent or the like. For example, a polytetrafluoroethylene powder, a metal salt of a higher fatty acid, cerium oxide, a polyethylene having a low molecular weight, a polypropylene having a low molecular weight or the like are acceptable for the additives.

On the other hand, the magnetic carrier used in the present invention may include any or all of the conventional ones including an iron powder carrier and a ferrite carrier. In addition, the magnetic carrier may be coated by a resin coating on the surface thereof, composed of a silicone resin, an acryl resin, a fluorine resin, an epoxy resin, a polyester resin or the like. Furthermore, a granulated magnetic resin carrier, produced by melting and kneading the mixture of the magnetic power and the binder resin and followed by granulating the mixture, is acceptable.

The developer for electrophotography according to the present invention is employed in a printer or an electric copy machine equipped with a developing device including a magnetic roll and a sleeve which encompasses the magnetic roll. In the developing device, the magnetic roll should rotate at a peripheral speed of 300 mm/sec or faster and the sleeve should rotate at a peripheral speed of 50 mm/sec or faster in opposite directions. In other words, the developer for electrophotography of the present invention is not acceptable in a developing device wherein a magnetic roll and a sleeve rotate in the same direction or in a developing device wherein the magnetic roll rotates at a peripheral speed of later than 300 mm/sec and the sleeve rotates at a peripheral speed of later than 50 mm/sec. In the case where the developer of the present invention is applied to the inadequate developing device described above, the carrier properties between the magnetic carrier and the magnetic toner magnetic-attracted on the sleeve surface are not adequate and result in a poor triboelectric charging. For this reason, the image density is lowered or the copied characters are incomplete.

The phrase "a peripheral speed" used here means a speed of the outer peripheral part of the magnetic roll or the sleeve.

As described above, since the magnetic toner employed in the present invention includes the magnetic powder having the coercive force (Hc) and the relation between saturation magnetization (Ms) and residual magnetization (Mr) which are defined in the predetermined range, a superior image quality can be obtained even in a developing device in which a sleeve or a magnetic roll rotates at a slower speed than that in the conventional device.

The following reasons are possibilities for why such effects can be obtained in the present invention:

By virtue of setting the coercive force (Hc) of the magnetic powder included in the magnetic toner in the range of 100 oersted or lower, advantages in the appropriate carrier properties can be afforded between the magnetic carrier and the magnetic toner which is magnetic-attracted on the sleeve surface. In addition, the triboelectric charging can be improved between the magnetic toner and the magnetic carrier, and between the magnetic toner and the blade, leading to an excellent image density. Due to the magnetic powder having the relation between saturation magnetization (Ms) and residual magnetization (Mr) of "$Ms/Mr \geqq 20$", the magnetic power of the magnetic toner developed on the photo-conductor is rapidly demagnetized, leading to a decrease in the effect of the magnetic power from the developing sleeve. For this reason, a high quality image, without defects, can be obtained.

[Examples]

The present invention will be explained in detail hereinbelow with reference to the examples. In the examples, all "parts" are "parts by weight", unless indicated otherwise.

Example 1

| Composition: | |
|---|---|
| Styrene/acrylate copolymer resin (Monomer composition: Styrene/Methylmethacrylate/Butyl acrylate = 78/5/17, Mn = 5,000, Mw = 14,000) | 100 parts |
| Magnetite ("MTZ-103", produced by Toda Kogyo Corp.) | 60 parts |
| Chromium containing metal dye ("SPILON BLACK TRH", produced by Hodogaya Chemical Industries, Co., Ltd.) | 1 part |
| Polypropyrene ("HIMER 200P", produced by Sanyo Chemical Industries Co., Ltd.) | 3 parts |

The mixture of the above-described composition was heat-melted and kneaded by means of a biaxial kneading machine. The kneaded mixture was pulverized in a jet mill, followed by classification using an air classifier to obtain a magnetic toner with an average particle size of 10 μm. 0.3 parts of a hydrophobic silica ("H 2000", produced by Hoechst Co., Ltd.) was added to 100 parts of the magnetic toner and mixed using a high-speed mixer ("Henschel Mixer", produced by Mitsui Miike Engineering Co., Ltd.) so as to cause the hydrophobic silica to adhere to the surface of the magnetic toner.

Comparative Example 1

| Composition: | |
|---|---|
| Styrene/acrylate copolymer resin (Monomer composition: Styrene/Methylmethacrylate/Butyl acrylate = 78/5/17, Mn = 5,000, Mw = 14,000) | 100 parts |
| Magnetite ("MAT-305", produced by Toda Kogyo Corp.) | 60 parts |
| Chromium containing metal dye ("SPILON BLACK TRH", produced by Hodogaya Chemical Industries, Co., Ltd.) | 1 part |
| Polypropyrene ("HIMER 200P", produced by Sanyo Chemical Industries Co., Ltd.) | 3 parts |

The mixture of the above-described composition was heat-melted and kneaded by means of a biaxial kneading machine. The kneaded mixture was pulverized in a jet mill, followed by classification using an air classifier to obtain a magnetic toner with an average particle size of 10 μm. 0.3 parts of a hydrophobic silica ("H 2000", produced by Hoechst Co., Ltd.) was added to 100 parts of the magnetic toner and mixed using a high-speed mixer ("Henschel Mixer", produced by Mitsui Miike Engineering Co., Ltd.) so as to cause the hydrophobic silica to adhere to the surface of the magnetic toner.

Comparative Example 2

| Composition: | |
|---|---|
| Styrene/acrylate copolymer resin (Monomer composition: Styrene/Methylmethacrylate/Butyl acrylate = 78/5/17, Mn = 5,000, Mw = 14,000) | 100 parts |
| Magnetite ("KBI-20V", produced by Kanto Denka Kogyo Corp.) | 60 parts |
| Chromium containing metal dye ("SPILON BLACK TRH", produced by Hodogaya Chemical Industries, Co., Ltd.) | 1 part |
| Polypropyrene ("HIMER 200P", produced by Sanyo Chemical Industries Co., Ltd.) | 3 parts |

The mixture of the above-described composition was heat-melted and kneaded by means of a biaxial kneading machine. The kneaded mixture was pulverized in a jet mill, followed by classification using an air classifier to obtain a magnetic toner with an average particle size of 10 μm. 0.3 parts of a hydrophobic silica ("H 2000", produced by Hoechst Co., Ltd. ) was added to 100 parts of the magnetic toner and mixed using a high-speed mixer ("Henschel Mixer", produced by Mitsui Miike Engineering Co., Ltd.) so as to cause the hydrophobic silica to adhere to the surface of the magnetic toner.

The magnetic properties of each of the magnetic powders employed in Example 1 and Comparative Examples 1 and 2 are shown in Table 1.

TABLE 1

| | Magnetic powders | | |
|---|---|---|---|
| | MTZ-103 (Example 1) | MAT-305 (Comparative Example 1) | KBI-20V (Comparative Example 2) |
| Saturation magnetization (Ms) (emu/g) | 70.0 | 85.0 | 86.0 |
| Residual magnetization (Mr) (emu/g) | 3.0 | 6.0 | 21.0 |
| Ms/Mr | 23.3 | 14.2 | 4.1 |
| Coercive force (Hc) (oersted) | 38.0 | 60.0 | 200.0 |

Next, 18 parts of an acryl-coated ferrite carrier was added to 100 parts of each of the magnetic toners obtained in Example 1 and Comparative Examples 1 and 2. Thus, one developer for electrophotography of the present invention (referred to as "Developer No. 1 of the present invention") and two comparative developers for electrophotography (referred to as "Comparative developers No. 1 and No. 2").

Developer No. 1 of the present invention and Comparative developer Nos. 1 and 2 were subjected to a continuous copying test (from 1 sheet to 10,000 sheets) by means of a modified laser printer wherein a commercially available laser printer ("PC-406 Lm", produced by NEC, revolution frequency of a sleeve: 180 rpm; revolution frequency of a magnetic roll: 1200 rpm; peripheral speed of a sleeve: 188 mm/sec; and peripheral speed of a magnetic roll: 1068 mm/sec) was modified so that the revolution frequency of the sleeve, the revolution frequency of the magnetic roll, the peripheral speed of the sleeve, and the peripheral speed of the magnetic roll were, respectively, replaced with 85 rpm, 600 rpm, 89 mm/sec, and 534 mm/sec.

The results of the continuous copying test are shown in Table 2.

The image density in Table 2 was measured by process measurements Macbeth RD-914 and fog density in Table 2 was measured by brightness by Hunter. The image quality in Table 2 was evaluated by visual observation. In the evaluation, "○" means an excellent quality of a copied image with neither a bled image nor a blurred image in the thin lines and characters of the copied image, and "×" means a poor quality of a copied image with a bled image or a blurred image in the thin lines and characters of the copied image.

TABLE 2

| | Initial stage | | | After 10,000 sheets | | |
|---|---|---|---|---|---|---|
| Sample No. | Image density | Fog density | Image quality | Image density | Fog density | Image quality |
| Developer No. 1 of the present invention | 1.40 | 0.46 | ○ | 1.40 | 0.42 | ○ |
| Comparative developer No. 1 | 1.18 | 0.36 | X | 1.08 | 0.32 | X |
| Comparative developer No. 2 | 1.45 | 0.51 | tailing image | 1.46 | 0.52 | tailing image |

As will be apparent from the results shown in Table 2, it has been confirmed that Developer No. 1 of the present invention exhibited not only a good image density but also an excellent image quality. Furthermore, the copied image using Developer No. 1 of the present invention had little fog density and neither bled nor blurred images in the thin lines and characters of the image.

In contrast to Developer No. 1 of the present invention, Comparative developer No. 1 had the image density of the 10,000th sheet which was lower than that of the initial sheet. In addition, both the bled image and the blurred image were found in the thin lines and characters of the copied image according to Comparative developer No. 1. The copied image obtained using Comparative developer No. 2 had an incomplete image such as the tailing image at the end part of the black solid image.

As described above, according to the present invention, an excellent image quality can be obtained in a developing system using a low-speed rotating sleeve or magnetic roll in a developing device. In addition, with the developer for electrophotography of the present invention, it is not necessary to have a high speed motor for driving the sleeve and the magnetic roll, nor the expanded capacity of the main motor, which must be present in the conventional developing device. For this reason, a developing system can be smaller in size and/or the developing device can cost less than the conventional one.

The present invention has been described in detail with respect to examples, and it should now be apparent from the foregoing, to those skilled in the art, that changes and modifications may be made without departing from the invention in its broader aspects, and it is the intention, therefore, in the appended claims to cover all such changes and modifications that fall within the true spirit of the invention.

What is claimed is:

1. A developer for electrophotography comprising a resin-coated magnetic carrier, and a magnetic toner which incorporates a binder resin and a magnetic powder having a saturation magnetization (Ms), residual magnetization (Mr) and coercive force (Hc) satisfying the following relationships in the case when an outer magnetic field of 5000 oersted is exerted on the magnetic powder:

$$Ms/Mr \geqq 20$$

$$Hc \leqq 100 \text{ oersted.}$$

2. A developer for electrophotography as recited in claim 1, wherein the resin of said resin-coated magnetic carrier is selected from the group consisting of an acryl resin, silicone resin, fluorine resin, epoxy resin, and polyester resin.

3. A developer for electrophotography as recited in claim 1, wherein the incorporation amount of said magnetic powder is 20 to about 70 parts by weight per 100 parts by weight of said binder resin.

4. A method for electrophotographic developing comprising the steps of:

(1) providing a developer for electrophotography comprising a resin-coated magnetic carrier, and a magnetic toner which incorporates a binder resin and a magnetic powder having a saturation magnetization (Ms), residual magnetization (Mr) and coercive force (Hc) satisfying the following relationships in the case when an outer magnetic field of 5000 oersted is exerted on the magnetic powder:

$$Ms/Mr \geqq 20$$

$$Hc \leqq 100 \text{ oersted;}$$

(2) providing a developing device equipped with a magnetic roll and a sleeve encompassing the magnetic roll;

(3) providing a photoconductor on which an electrostatic latent image is formed;

(4) subjecting a surface of the sleeve to a magnetic attraction using a developer for electrophotography;

(5) subsequently rotating the magnetic roll at a peripheral speed of 300 mm/sec or faster and the sleeve at a peripheral speed of 50 mm/sec or faster in opposite directions to carry said developer for electrophotography; and (6) subsequently transferring and contacting said developer for electrophotography with said photo-conductor on which said electrostatic latent image is formed to develop said electrostatic latent image.

5. A method for electrophotographic developing as recited in claim 4, wherein the resin of said resin-coated magnetic carrier is an acryl resin, silicone resin, fluorine resin, epoxy resin, or polyester resin.

6. A method for electrophotographic developing as recited in claim 4, wherein the amount of said magnetic powder is 20 to about 70 parts by weight per 100 parts by weight of said binder resin.

7. A method for electrophotographic developing as recited in claim 4, wherein the peripheral speed of the magnetic roll is 300 to about 534 mm/sec and the peripheral speed of the sleeve is 50 to about 89 mm/sec.

* * * * *